US010309159B2

(12) United States Patent
Wright

(10) Patent No.: US 10,309,159 B2
(45) Date of Patent: Jun. 4, 2019

(54) GROUND WORKING TOOL WITH REPLACEABLE TEETH

(71) Applicant: Digga Australia Pty Ltd., Queensland (AU)

(72) Inventor: Stewart James Wright, Queensland (AU)

(73) Assignee: Digga Australia Pty Ltd., Queensland (AU)

( * ) Notice: Subject to any disclaimer, the term of this patent is extended or adjusted under 35 U.S.C. 154(b) by 374 days.

(21) Appl. No.: 14/906,057

(22) PCT Filed: Jul. 18, 2014

(86) PCT No.: PCT/AU2014/050135

§ 371 (c)(1),
(2) Date: Jan. 19, 2016

(87) PCT Pub. No.: WO2015/006832

PCT Pub. Date: Jan. 22, 2015

(65) Prior Publication Data

US 2016/0160571 A1 Jun. 9, 2016

(30) Foreign Application Priority Data

Jul. 19, 2013 (AU) ..... 2013902698

(51) Int. Cl.
*E21B 10/43* (2006.01)
*E21B 10/44* (2006.01)
(Continued)

(52) U.S. Cl.
CPC ..... *E21B 10/633* (2013.01); *E02F 3/083* (2013.01); *E02F 9/2825* (2013.01);
(Continued)

(58) Field of Classification Search
CPC ..... E21B 10/43; E21B 10/44; E21B 10/62; E21B 10/633; E02F 3/083; E02F 9/2825; E02F 9/2833; E02F 9/2866; E02F 9/2883
See application file for complete search history.

(56) References Cited

U.S. PATENT DOCUMENTS 1,461,136 A 7/1923 Moore
3,286,378 A 11/1966 Beneti
(Continued)

FOREIGN PATENT DOCUMENTS

EP 0195107 9/1986
JP H07-4170 1/1995
WO WO-2007079527 A1 * 7/2007 ..... E02F 9/2816

*Primary Examiner* — Matthew R Buck
(74) *Attorney, Agent, or Firm* — Hartman Global IP Law; Gary M. Hartman; Domenica N. S. Hartman

(57) ABSTRACT

A ground working tool comprises a tooth holder (70) and a replaceable tooth (30), the tooth holder (70) comprising a recess (74) for receiving at least part of a tooth (30), the recess (74) having an upper surface (80) and an opposed lower surface (78), at least one projection (92, 94) of hard material extending from the upper surface or the lower surface of the recess of the tooth holder (74), the tooth (30) comprising a distal part (32) for engaging or working the ground or earth during use and a proximal part (34), the proximal part (34) of the tooth (30) being received within the recess (74) of the tooth holder (70), the proximal part (34) of the tooth having an upper surface (33) and a lower surface (35), the tooth (30) having at least one recess (60, 62) on the upper surface or the lower surface of the proximal part thereof, the at least one recess (60, 62) being of complementary size and shape to the at least one projection (92, 94) of hard material in the recess of the tooth holder such that the at least one projection is positioned within the at least one recess of the tooth when the tooth is fully inserted in the recess of the tooth holder.

15 Claims, 3 Drawing Sheets

(51) Int. Cl.

| | |
|---|---|
| ***E21B 10/62*** | (2006.01) |
| ***E21B 10/633*** | (2006.01) |
| ***E02F 9/28*** | (2006.01) |
| ***E02F 3/08*** | (2006.01) |

(52) U.S. Cl.
CPC ..... *E02F 9/2833* (2013.01); *E02F 9/2866* (2013.01); *E02F 9/2883* (2013.01); *E21B 10/43* (2013.01); *E21B 10/44* (2013.01); *E21B 10/62* (2013.01)

(56) References Cited

U.S. PATENT DOCUMENTS

| | | | | | |
|---|---|---|---|---|---|
| 3,292,281 | A * | 12/1966 | Petersen | ..... | E02F 9/2841 172/750 |
| 5,987,787 | A * | 11/1999 | Mack | ..... | E02F 9/2825 172/713 |
| 7,383,901 | B2 | 6/2008 | Rayner | | |
| 2004/0060207 | A1* | 4/2004 | Livesay | ..... | E02F 9/2825 37/451 |

* cited by examiner

GROUND WORKING TOOL WITH REPLACEABLE TEETH

TECHNICAL FIELD

The present invention relates to a ground working tool with replaceable teeth. The present invention also relates to a tooth holder and to a replaceable tooth for use with the ground working tool.

BACKGROUND ART

Ground working tools or tools that are used to move earth typically have a number of teeth. For example, excavator buckets have a number of teeth at the front edge of the bucket. Augers typically comprise a screw that is rotated by a drive unit. As the screw rotates, it digs into the ground and removes earth to thereby form a hole. In order to increase the efficiency of digging using an auger, the leading edge of the screw is often provided with a number of teeth.

The ground engaging teeth of ground working tools are subject to large loads and high wear. A number of strategies have been developed in order to minimise wear and extend the life of the ground engaging teeth. For example, ground engaging teeth often have a hard facing applied to the ground engaging surfaces thereof. Although this does increase the working life of the ground engaging teeth, ultimately the ground engaging teeth will wear out and will need to be replaced.

It is desirable that replaceable ground engaging teeth be easy to fit to the ground working tool, be firmly retained in place during use of the ground engaging tool and be easily removed once they have worn in order to minimise downtime with the tool. A number of different proposals have been put forward to mount replaceable teeth in ground working tools.

Most ground working tools are provided with one or more tooth holders that hold the replaceable teeth. Each tooth holder may comprise a pocket or a recess. The replaceable tooth can be inserted into the pocket or recess. The pocket or recess of the tooth holder may have an open front and open sides. The tooth is inserted into the tooth holder and retained in place using various mechanisms.

A number of replaceable teeth are held in place using deformable rubber members or resilient inserts. Some examples are shown in U.S. Pat. Nos. 3,359,662, 3,323,235 and Australian patent number 2004203825. In other embodiments, rubber pads are joined to the upper and lower surfaces of the tooth and act to increase the friction between the upper and lower surfaces of the tooth and the facing surfaces of the tooth holder. Other examples utilise a retaining pin that passes through apertures in the tooth holder that come into alignment with an aperture or a notch in the tooth. When the retaining pin is inserted in place, the retaining pin prevents removal of the tooth from the tooth holder. It has been found and that during use of the ground working tool, the tooth can firmly wedge against the retaining pin, thereby making it very difficult to remove the retaining pin when it is time to replace a worn tooth.

Replaceable teeth that are used in augers often comprise a distal end that forms the working surface of the tooth and a proximal end that is in the form of two spaced legs. The tooth holder comprises a recess or a pocket having an upper surface and an opposed lower surface, with a web extending between the upper and lower surfaces. The web is shaped such that it is of complementary shape to the slot formed by the space between the two spaced legs. When the tooth is inserted into the tooth holder, the two legs extend on either side of the central web of the tooth holder. Resilient members, rubber members, and/or retaining pins are then used to retain the replaceable tooth in position.

It will be clearly understood that, if a prior art publication is referred to herein, this reference does not constitute an admission that the publication forms part of the common general knowledge in the art in Australia or in any other country.

SUMMARY OF INVENTION

The present invention is directed to a ground working tool, a replaceable tooth and a tooth holder, which may at least partially overcome at least one of the abovementioned disadvantages or provide the consumer with a useful or commercial choice.

In a first aspect, the present invention provides a ground working tool comprising a tooth holder and a replaceable tooth, the tooth holder comprising a recess for receiving at least part of a tooth, the recess having an upper surface and an opposed lower surface, at least one projection of hard material extending from the upper surface or the lower surface of the recess of the tooth holder, the tooth comprising a distal part for engaging or working the ground or earth during use and a proximal part, the proximal part of the tooth being received within the recess of the tooth holder, the proximal part of the tooth having an upper surface and a lower surface, the tooth having at least one recess on the upper surface or the lower surface of the proximal part thereof, the at least one recess being of complementary size and shape to the at least one projection of hard material in the recess of the tooth holder, such that the at least one projection is positioned within the at least one recess of the tooth when the tooth is fully inserted in the recess of the tooth holder.

In one embodiment, the at least one recess on the tooth and the at least one projection of hard material in the recess of the tooth holder are arranged such that the tooth can only be fully inserted into the recess of the tooth holder in a single orientation.

In another embodiment, the at least one recess on the tooth and the at least one projection of hard material in the recess of the tooth holder are arranged such that the at least one projection is positioned within the at least one recess of the tooth to thereby locate the tooth within the recess of the tooth holder and minimise lateral movement of the tooth during use.

In one embodiment, the at least one projection is located on one only of the upper surface or the lower surface of the recess of the tooth holder and the at least one recess of the tooth is located on one only of the upper surface or the lower surface of the tooth. In this manner, when the tooth is inserted into the tooth holder in the correct orientation, the at least one recess of the tooth passes over and receives the at least one projection of the tooth holder. However, if the tooth is inserted in an incorrect orientation (such as upside down), the at least one recess of the tooth is out of alignment with the at least one projection of the tooth holder and this prevents full insertion of the tooth into the recess of the tooth holder.

In another embodiment, the upper surface and the lower surface of the recess of the tooth holder may be provided with projections of different size, such as projections having different width, and the upper surface and the lower surface of the tooth may be provided with recesses having sizes that are complementary to the sizes of the respective projections on the upper surface and lower surface of the recess of the tooth holder. If the tooth is inserted into the recess of the tooth holder in an incorrect orientation, due to the differing sizes of the recesses of the tooth and the projections in the tooth holder, at least one of the projections will not fit into at least one of the recesses on the tooth, thereby preventing full insertion of the tooth in the incorrect orientation. When the tooth is inserted into the tooth holder in the correct orientation, the respective projections of the tooth holder and recesses of the tooth will be properly aligned, thereby allowing full insertion of the tooth.

In some embodiments, the tooth includes two spaced legs that form the proximal part of the tooth, the two spaced legs each having an inner surface that faces an inner surface of the other leg, and each leg having an end surface.

In one embodiment, each leg is provided with a recess extending from an end surface towards a distal end of the tooth. In some embodiments, each recess has a distal end that terminates within the leg. In this manner, the distal end of each recess terminates in a shoulder.

In some embodiments, each projection in the recess of the tooth holder comprises a straight projection extending in a direction generally parallel to a side wall of the tooth holder. Similarly, each recess in the tooth may comprise a straight recess extending in a direction generally parallel to a side wall of the tooth.

In some embodiments, a distal end of each projection contacts a distal end of each recess of the tooth and side walls of each projection contact side walls of each respective recess of the tooth. In this manner, the tooth is firmly held against lateral movement. This is further facilitated by the projections in the recess of the tooth being formed from a hard material. The projections may be made from the same material as the tooth holder. The tooth holder (including the projections) may be manufactured by casting or moulding metal.

In some embodiments, the tooth is provided with a notch or opening for receiving a retaining pin. The tooth holder may include an opening that can come into alignment with the notch or opening of the tooth so that the retaining pin can pass through the tooth holder and through the notch or opening of the tooth to thereby retain the tooth in the tooth holder.

In some embodiments, the tooth may be provided with resilient pads, such as vulcanised rubber pads, to further assist in holding the tooth in the tooth holder. The resilient pads may be positioned on an upper surface of the tooth, on a lower surface of the tooth, or on both the upper and lower surfaces of the tooth. The resilient pads may be positioned on the upper surfaces of each leg of the tooth, on the lower surfaces of each leg of the tooth or on both the upper and lower surfaces of each leg of the tooth. The resilient pads may be bonded to the tooth.

In some embodiments, the tooth has two spaced legs and the tooth holder includes a web extending between the upper surface and the lower surface of the recess of the tooth holder, the web being located between the legs of the tooth when the tooth is inserted into the tooth holder. Preferably, the web is of complementary size and shape to fit within the space between the legs of the tooth. In this way, the inside walls of the spaced legs of the tooth are positioned close to or in contact with the side walls of the web which also assists in maintaining the lateral position of the tooth.

In a second aspect, the present invention provides a replaceable tooth for use with a ground working tool, the ground working tool having a tooth holder, the tooth holder comprising a recess for receiving at least part of a tooth, the recess having an upper surface and an opposed lower surface, at least one projection of hard material extending from the upper surface or the lower surface of the recess of the tooth holder, the tooth comprising a distal part for engaging or working the ground or earth during use and a proximal part, the proximal part of the tooth being received within the recess of the tooth holder, the proximal part of the tooth having an upper surface and a lower surface, the tooth having at least one recess on the upper surface or the lower surface of the proximal part thereof, the at least one recess being of complementary size and shape to the at least one projection of hard material in the recess of the tooth holder such that the at least one projection is adapted to be positioned within the at least one recess of the tooth when the tooth is fully inserted into the tooth holder.

The tooth may further comprise any of the features described above with reference to the first aspect of the present invention.

In a third aspect, the present invention provides a tooth holder for a ground working tool, the tooth holder comprising a recess for receiving at least part of a tooth, the recess having an upper surface and an opposed lower surface, at least one projection of hard material extending from the upper surface or the lower surface of the recess of the tooth holder, the tooth comprising a distal part for engaging or working the ground or earth during use and a proximal part, the proximal part of the tooth being received within the recess of the tooth holder, the proximal part of the tooth having an upper surface and a lower surface, the tooth having at least one recess on the upper surface or the lower surface of the proximal part thereof, the at least one recess being of complementary size and shape to the at least one projection of hard material into the recess of the tooth holder such that the at least one projection is adapted to be positioned within the at least one recess of the tooth when the tooth is fully inserted into the tooth holder.

The tooth holder may further comprise any of the features described above with reference to the first aspect of the present invention.

In other aspects of the present invention, the one or more recesses may be provided in the upper surface or the lower surface of the tooth holder and the one or more projections may be provided on the upper surface or lower surface of the tooth. In these aspects, the recess(es) in the tooth holder that is adapted to receive the projection(s) on the tooth will extend from the front or distal end of the tooth holder.

Any of the features described herein can be combined in any combination with any one or more of the other features described herein within the scope of the invention.

DESCRIPTION OF EMBODIMENTS

It will be appreciated that the drawings have been provided for the purposes of illustrating preferred embodiments of the present invention. Therefore, it will be understood that the present invention should not be considered to be limited solely to the features as shown in the attached drawings.

Figure 1:
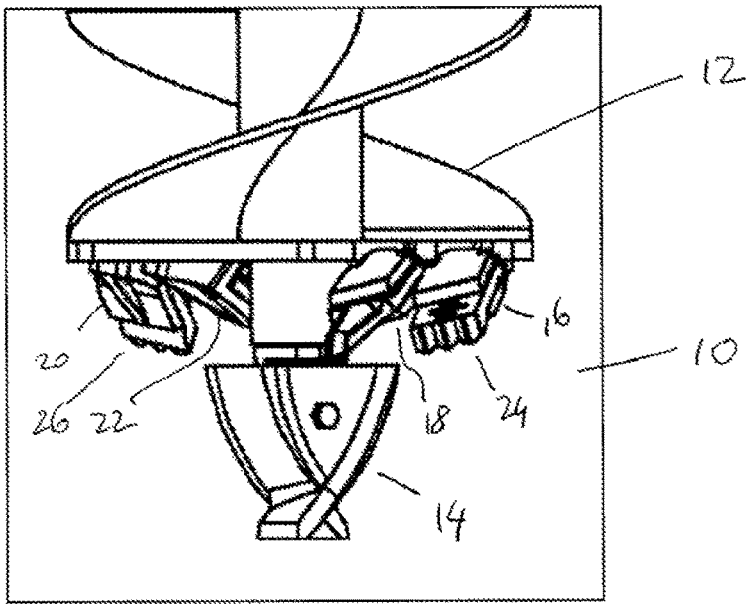
FIG. 1 shows a perspective view of an auger having a plurality of replaceable teeth.

FIG. 1 shows an auger 10. The auger 10 includes a screw flight 12. The screw flight 12 is rotated by a drive unit (not shown) and the screw flight digs into the ground and removes earth to leave a bore hole in the ground. The auger 10 is fitted with an attack bit 14 fitted to the lower end thereof. The attack bit 14 assists the auger in penetrating into the ground.

In order to further improve digging or drilling of the borehole in the ground, the leading edge of the screw flight 12 is fitted with a plurality of replaceable teeth. In particular, the leading edge of the screw flight 12 is fitted with tooth holders 16, 18, 20, 22. The tooth holders 16, 18, 20, 22 may be welded to the leading edge of the screw flight 12. Each tooth holder is fitted with a replaceable tooth, some of which are numbered at 24 and 26. The person skilled in the art will readily understand that augurs can be fitted with tooth holders and replaceable teeth.

FIGS. 2 to 7 show various views of a replaceable tooth (FIGS. 2 and 3) and a tooth holder (FIGS. 4 to 7) in accordance with embodiments of the present invention that can be used with augers or other ground engaging tools.

Figure 2:
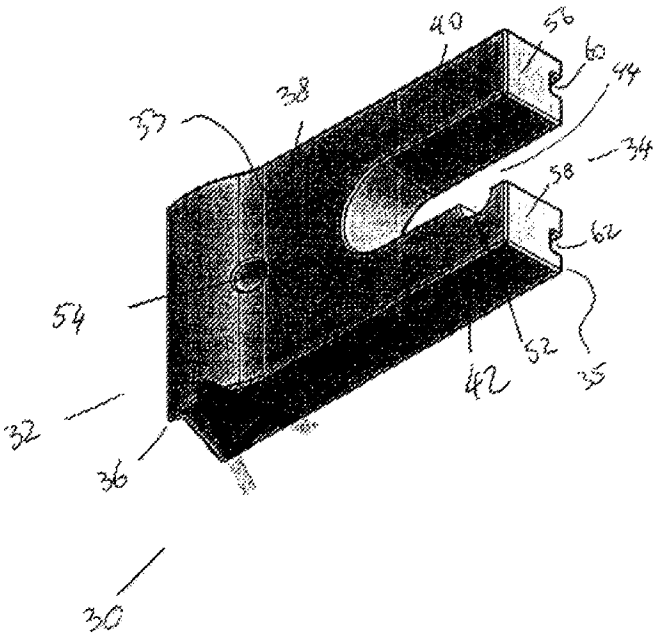
FIG. 2 shows a perspective view of a tooth in accordance with an embodiment of the present invention.

FIG. 2 shows a perspective view of a replaceable tooth 30. The replaceable tooth 30 has a distal end 32 and a proximal end 34. Throughout this specification, the term "proximal" is intended to relate to the part of the tooth or tooth holder that is closest to the auger shaft in use, whereas the term "distal" is intended to relate to the part of the tooth or tooth holder that is further away from the auger shaft in use. The replaceable tooth 30 has an upper surface 33 and a lower surface 35. The upper surface 33 is opposite the lower surface 35. The distal end 32 comprises a ground engaging surface 36 that may comprise a hard face material. The person skilled in the art will understand that the ground engaging surface 36 at the distal end 32 of replaceable tooth 30 may have a number of different designs or shapes. The exact shape of the ground engaging surface 36 is not critical to the present invention.

The replaceable tooth 30 has a tooth body 38 and two rearwardly extending legs 40, 42. The legs 40, 42 are spaced from each other and a slot 44 is defined between the inner surfaces of the respective legs 40, 42. As can be seen, the slot 44 has straight side walls 46, 48 and a curved distal wall 50. The slot 44 has an open proximal end.

The inner wall of leg 42 has a notch 52 formed therein. The notch 52 is adapted to receive a retaining pin to assist in retaining the tooth 30 in the tooth holder. This will be described in more detail hereunder.

As can best be seen in FIG. 2, the distal end of the tooth 30 is thicker than the proximal end of the tooth 30. An opening 54 is formed in the upper surface of the distal end of the tooth 30. The opening 54 extends a short way into the body of the tooth. The opening 54 has a blind lower end. The opening 54 is adapted to receive the end of a tool, such as a punch or a screwdriver, to assist in driving the tooth 30 out of the tooth holder when it is desired to replace a worn tooth.

Figure 3:
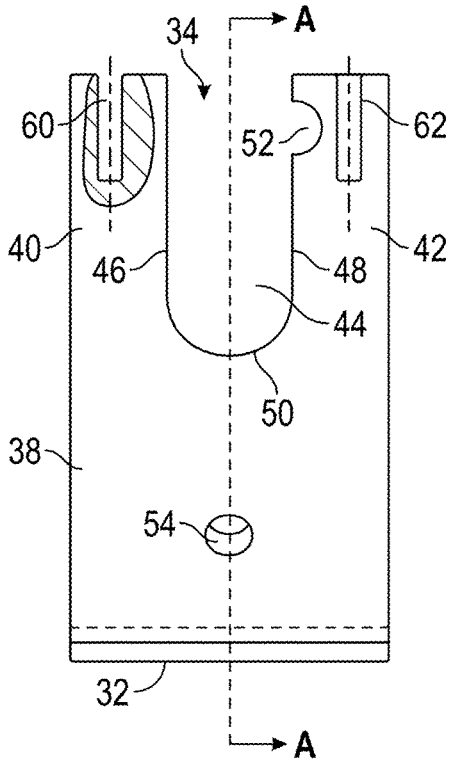
FIG. 3 shows a plan view, partly in cross-section, of the tooth shown in FIG. 1.
Figure 4:
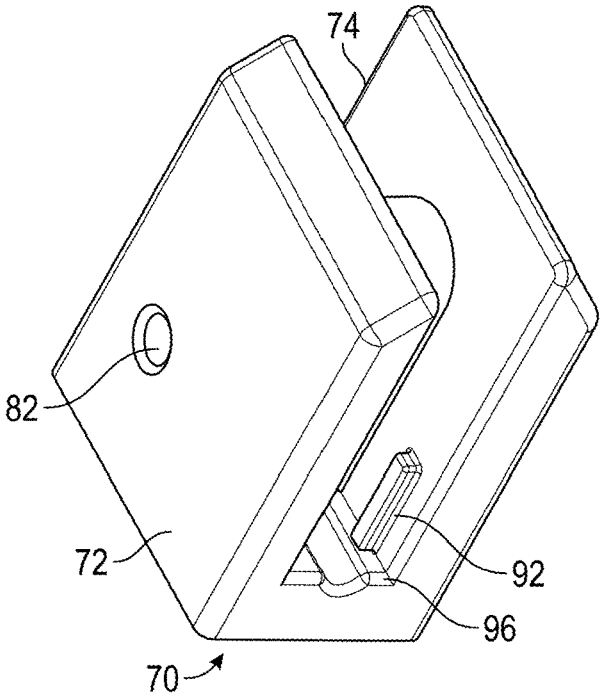
FIG. 4 shows a perspective view of a tooth holder in accordance with an embodiment of the present invention.
Figure 5:
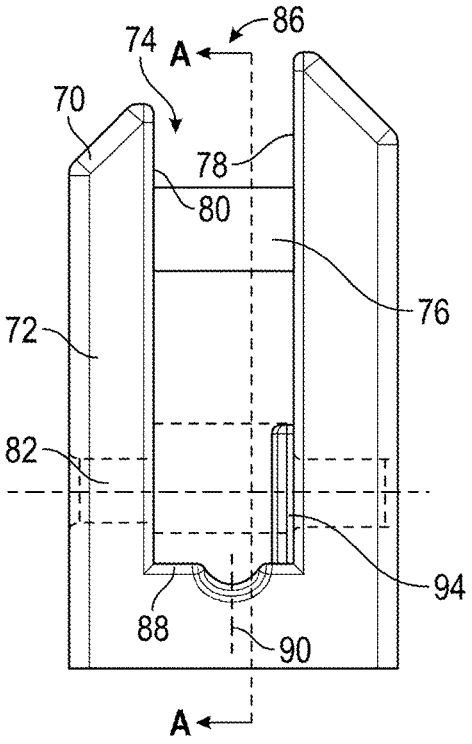
FIG. 5 shows a side view of the tooth holder shown in FIG. 3.

The proximal ends of the legs 40, 42 have respective end surfaces 56, 58. The lower surfaces of the legs 40, 42 are each provided with a recess 60, 62. As can be seen from FIG. 2, recesses 60, 62 open into the respective end surfaces 56, 58 of the legs 40, 42. The recesses 60, 62 are in the form of straight slots extending from the end surfaces 56, 58 towards the distal end of the tooth 30. The recesses 60, 62 are also shown in FIG. 3, with the portion of the tooth above recess 60 being removed to clearly show recess 60, and with recess 62 being shown in dotted outline. As can be seen from FIG. 3, the recesses 60, 62 have a length that is about half the length of the straight portion of the legs 40, 42. The distal ends of the recesses 60, 62 form a shoulder.

As can be seen from FIGS. 2 and 3, the recesses 60, 62 are formed in only the lower surface 35 of the tooth 30. There are no similar recesses formed in the upper surface 33 of the tooth 30.

Although not shown in FIG. 2, the replaceable tooth 30 may also be provided with one or more rubber pads bonded thereto in order to more securely retain the tooth 30 in a tooth holder.

FIGS. 4 to 7 show various views of a tooth holder 70 in accordance with an embodiment of the present invention. The tooth holder 70 comprises a tooth holder body 72. The tooth holder body 72 defines a recess 74. The recess 74 has a central web 76 that extends from a lower surface 78 of the recess to an upper surface 80 of the recess. The central web 76 can be seen in FIG. 6. As can be seen from FIG. 6, the central web 76 has a shape that is complementary to the shape of the slot 44 in the replaceable tooth 30.

Figure 6:
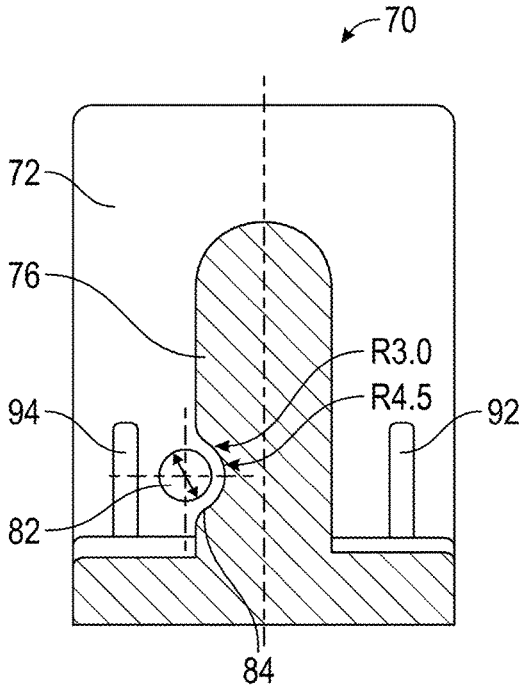
FIG. 6 shows a cross sectional top view, taken along section line A-A in FIG. 4, of the tooth holder shown in FIG. 3.
Figure 7:
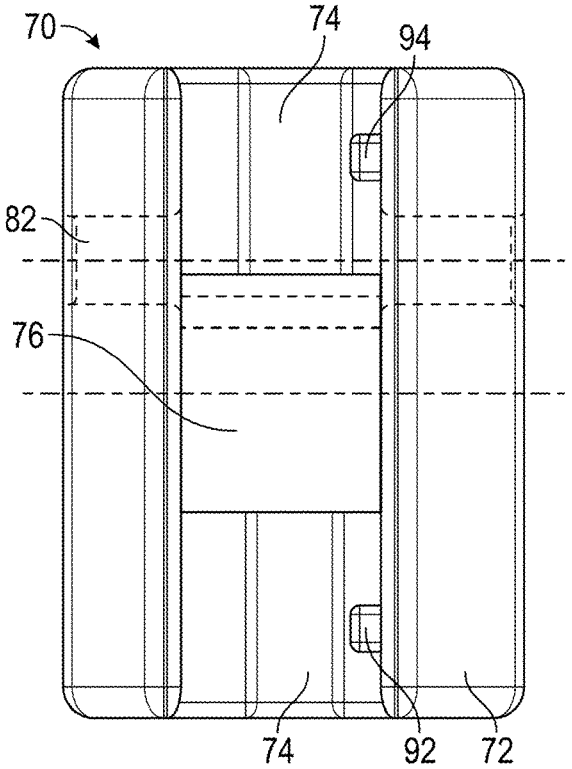
FIG. 7 shows a front view of the tooth holder shown in FIG. 3.

The tooth holder 70 is also provided with an opening 82 that extends through the tooth holder 70. This can be more clearly seen in FIG. 5 and FIG. 7. The opening 82 also forms a notch 84 in the central web 76, is best shown in FIG. 6.

The recess 74 has an open distal end 86 and a closed proximal end 88. The proximal end 88 has a notch 90 formed therein. The purpose and use of notch 90 will be explained hereunder.

The lower surface 78 of recess 74 is also provided with projections 92, 94. The projections 92, 94 extends upwardly from the lower surface 78. Projection 92 is located on the opposite side of the web 76 to the projection and 94. The projections 92, 94 are suitably made from the same material as the rest of the tooth holder 70. The projections 92, 94 are of complementary size and shape to the recesses 60, 62 that are formed on the lower surface of the replaceable tooth 30. In the embodiment shown in FIGS. 4 to 7, the projections 92, 94 are shaped as rectangular prisms. The projections 92, 94 extends from the inner wall 96 of recess 74. The projections 92, 94 extend in a direction that is generally parallel to the side walls of the tooth holder 70. The projections 92, 94 have a height that is generally similar to the depth of the recesses 60, 62. The projections 92, 94 have a length that is generally similar to the length of the recesses 60, 62.

In order to mount the replaceable tooth 30 in the tooth holder 70, the tooth 30 is oriented such that the lower surface 35 of the tooth 30 comes into contact with the lower surface 78 of the recess 74 of tooth holder 70. The tooth 30 is then pushed inwardly, such as by hammering it into place with a blunt tool such as a copper hammer or a piece of timber, such that it slides into the recess 74. The lower surface of recess 74 contacts the lower surface of tooth 30 and the upper surface 80 of recess 74 contacts the upper surface of tooth 30. As insertion of the tooth 30 into the recess 74 continues, the open proximal ends of the recesses 60, 62 on the tooth 30 come into alignment with the projections 92, 94. As insertion of the tooth continues, the recesses 60, 62 slide over the projections 92, 94 until the proximal ends 56, 58 of the legs 40, 42 of the tooth 30 come into contact with the inner wall 96 of recess 74. At this stage, the shoulder at the outer ends or distal ends of the projections 92, 94 has just come into contact with the shoulder at the distal ends of the recesses 60, 62. Further, the side walls of the recesses 60, 62 are in close juxtaposition with or in contact with the side walls of the projections 92, 94. Similarly, the side walls 46, 48 of the slot 44 defined between the legs 40, 42 of the replaceable tooth 30 are in contact with the side walls of the web 76 and the curved distal wall 50 of the slot 44 is also in contact with the complementary shaped curved distal wall of the web 76. As a result, the tooth is firmly held against lateral movement by the central web 76 and by the contact or engagement between the projections 92, 94 and the recesses 60, 62. It will be understood that this minimises lateral movement of the tooth during use of the ground working tool. As a result, more even wear across the distal end of the tooth can be expected to be obtained during use. This also helps maintain the tooth in the correct alignment to maintain concentricity during cutting or digging.

As a further advantage of the present invention, it is not possible to insert the tooth in an incorrect orientation. Experience has shown that many operators of augers insert replaceable teeth in an upside down configuration. This results in less efficient digging of a borehole. However, in this embodiment of the present invention, if the tooth is inserted in an upside down configuration, what should be the upper surface of the tooth (which has no recesses formed in it) will come into contact with the projections 92, 94. At this point, the tooth will only be partly inserted into the recess of the tooth holder. Further insertion of the tooth is not possible because the solid ends of the legs of the tooth will come into contact with the distal ends of the projections 92, 94. Thus, the operator will quickly realise that the tooth cannot be fully inserted because it is not in the correct orientation.

Once the tooth has been fully inserted, the notch 52 in the leg 42 of the tooth 30 will be located in alignment with the notch 84 in the web 76 of the tooth holder 70. The respective notches 52, 84 will define an opening that is in alignment with opening 82 in the body of the tooth holder. A retaining pin (not shown) can then be inserted through the opening 82 to thereby provide further retention of the tooth 30 in the tooth holder 70. Provision of one or more rubber pads on the upper surface of the tooth or the lower surface of the tooth will also provide enhanced retaining of the tooth in the tooth holder.

It will be appreciated that the present invention may be subjected to a number of variations or modifications. For example, the tooth may be provided with the projections whilst the tooth holder may be provided with the recesses. In this embodiment, the recesses in the tooth holder will extend from the front face (distal face) of the tooth holder. Alternatively, recesses of differing widths may be provided on the upper and lower surfaces of the tooth, with complementary sized projections also being provided on the upper and lower surfaces of the recess of the tooth holder. In this manner, if the tooth is inserted in an upside down configuration, an incorrectly sized recess will contact a projection and further insertion of the tooth will not be possible.

Once the tooth has been used and is worn out, it will need to be replaced. In order to replace the tooth, the retaining pin is removed. As the tooth has been more securely held against lateral movement, deformation or wedging of the retaining pin is less likely to occur and therefore it will be easier to remove the retaining pin. In known replaceable teeth, there have been instances where lateral movement of the tooth during digging has caused a retaining pin to become deformed or wedged, thereby making it very difficult to remove the retaining pin. Indeed, there have been instances where it has been necessary to drill out the retaining pin in order to be able to remove the tooth from the tooth holder. This increases the time taken to replace a tooth which, in turn, increases down time of the auger.

Following removal of the retaining pin, the tooth may be removed from the tooth holder. If the tooth proves to be difficult to remove, a punch may be placed in an opening 54 and a hammer used to hit the punch and drive the tooth out of the tooth holder. A fresh replacement tooth may then be inserted into the tooth holder and a retaining pin returned. Alternatively, a punch may be inserted into notch 88 so that the punch can contact the end surface of a leg of the tooth and be used to drive out the tooth from the tooth holder.

One further advantage of the replaceable tooth shown in FIGS. 2 and 3 is that the tooth 30 can be used in existing tooth holders that do not have complementary projections in the recess of the tooth holder.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A ground working tool comprising a tooth holder and a replaceable tooth, the tooth holder comprising a recess for receiving at least part of the tooth, the recess having an upper surface and an opposed lower surface, at least one projection of hard material extending from the upper surface or the lower surface of the recess of the tooth holder, the tooth comprising a distal part for engaging or working the ground or earth during use and a proximal part, the proximal part of the tooth being received within the recess of the tooth holder, the proximal part of the tooth having an upper surface and a lower surface, the tooth having at least one recess on the upper surface or the lower surface of the proximal part thereof, the at least one recess being of complementary size and shape to the at least one projection of hard material in the recess of the tooth holder such that the at least one projection is positioned within and contacts the at least one recess of the tooth when the tooth is fully inserted in the recess of the tooth holder, the at least one recess on the tooth and the at least one projection of hard material in the recess of the tooth holder being arranged such that the tooth can only be fully inserted into the recess of the tooth holder in a single orientation to the tooth holder and the hard material of the at least one projection being sufficiently hard to assist in firmly holding the tooth against lateral movement relative to the tooth holder to maintain alignment of the tooth in the ground working tool and prevent the tooth from being inserted into the recess of the tooth holder when the tooth is not in the single orientation, the at least one projection in the recess of the tooth holder comprising a straight projection extending in a direction generally parallel to a side wall of the tooth holder and the at least one recess in the tooth comprising a straight recess extending in a direction generally parallel to a side wall of the tooth, and the at least one recess on the tooth extending from a proximal end of the tooth towards a distal end of the tooth;

wherein the at least one projection is located on one only of the upper surface or the lower surface of the recess of the tooth holder and the at least one recess of the tooth is located on one only of the upper surface or the lower surface of the tooth.

2. A ground working tool as claimed in claim 1 wherein the at least one recess on the tooth and the at least one projection of hard material in the recess of the tooth holder are arranged such that the at least one projection is positioned within the at least one recess of the tooth to thereby locate the tooth within the recess of the tooth holder and minimise lateral movement of the tooth during use.

3. A ground working tool as claimed in claim 1 wherein the tooth includes two spaced legs that form the proximal part of the tooth, the two spaced legs each having an inner surface that faces an inner surface of the other leg, and each leg having an end surface.

4. A ground working tool as claimed in claim 3 wherein each leg is provided with a recess extending from the end surface towards the distal end of the tooth.

5. A ground working tool as claimed in claim 1 wherein a distal end of the at least one projection contacts a distal end of the at least one recess of the tooth and side walls of the at least one projection contact side walls of the at least one recess of the tooth.

6. A ground working tool as claimed in claim 1 wherein the tooth is provided with a notch or opening for receiving a retaining pin and the tooth holder includes an opening that comes into alignment with the notch or opening of the tooth so that the retaining pin can pass through the tooth holder and through the notch or opening of the tooth to thereby retain the tooth in the tooth holder, or the tooth is provided with one or more resilient pads positioned on the upper surface of the tooth, on the lower surface of the tooth, or on both the upper and lower surfaces of the tooth.

7. A ground working tool as claimed in claim 1 wherein the tooth has two spaced legs and the tooth holder includes a web extending between the upper surface and the lower surface of the recess of the tooth holder, the web being located between the legs of the tooth when the tooth is inserted into the tooth holder.

8. A ground working tool as claimed in claim 7 wherein the web is of complementary size and shape to fit within the space between the legs of the tooth such that inside walls of the spaced legs of the tooth are positioned close to or in contact with side walls of the web.

9. A replaceable tooth for use with a ground working tool, the ground working tool having a tooth holder, the tooth holder comprising a recess for receiving at least part of the tooth, the recess having an upper surface and an opposed lower surface, at least one projection of hard material extending from the upper surface or the lower surface of the recess of the tooth holder, the tooth comprising a distal part for engaging or working the ground or earth during use and a proximal part, the proximal part of the tooth being received within the recess of the tooth holder, the proximal part of the tooth having an upper surface and a lower surface, the tooth having at least one recess on the upper surface or the lower surface of the proximal part thereof, the at least one recess being of complementary size and shape to the at least one projection of hard material in the recess of the tooth holder such that the at least one projection is adapted to be positioned within the at least one recess of the tooth when the tooth is fully inserted into the tooth holder, the at least one recess on the tooth and the at least one projection of hard material in the recess of the tooth holder being arranged such that the tooth can only be fully inserted into the recess of the tooth holder in a single orientation to the tooth holder and the hard material of the at least one projection being sufficiently hard to assist in firmly holding the tooth against lateral movement relative to the tooth holder to maintain alignment of the tooth in the ground working tool and prevent the tooth from being inserted into the recess of the tooth holder when the tooth is not in the single orientation, the at least one projection in the recess of the tooth holder comprising a straight projection extending in a direction generally parallel to a side wall of the tooth holder and the at least one recess in the tooth comprising a straight recess extending in a direction generally parallel to a side wall of the tooth, and the at least one recess on the tooth extending from a proximal end of the tooth towards a distal end of the tooth;

wherein the at least one projection is located on one only of the upper surface or the lower surface of the recess of the tooth holder and the at least one recess of the tooth is located on one only of the upper surface or the lower surface of the tooth.

10. A replaceable tooth as claimed in claim 9 wherein the tooth includes two spaced legs that form the proximal part of the tooth, the two spaced legs each having an inner surface that faces an inner surface of the other leg, and each leg having an end surface.

11. A replaceable tooth as claimed in claim 10 wherein each leg is provided with a recess extending from the end surface towards the distal end of the tooth.

12. A tooth holder fora ground working tool, the tooth holder comprising a recess for receiving at least part of a tooth, the recess having an upper surface and an opposed lower surface, at least one projection of hard material extending from the upper surface or the lower surface of the recess of the tooth holder, the tooth comprising a distal part for engaging or working the ground or earth during use and a proximal part, the proximal part of the tooth being received within the recess of the tooth holder, the proximal part of the tooth having an upper surface and a lower surface, the tooth having at least one recess on the upper surface or the lower surface of the proximal part thereof, the at least one recess being of complementary size and shape to the at least one projection of hard material into the recess of the tooth holder such that the at least one projection is adapted to be positioned within the at least one recess of the tooth when the tooth is fully inserted into the tooth holder, the at least one recess on the tooth and the at least one projection of hard material in the recess of the tooth holder being arranged such that the tooth can only be fully inserted into the recess of the tooth holder in a single orientation to the tooth holder and the hard material of the at least one projection being sufficiently hard to assist in firmly holding the tooth against lateral movement relative to the tooth holder to maintain alignment of the tooth in the ground working tool and prevent the tooth from being inserted into the recess of the tooth holder when the tooth is not in the single orientation, the at least one projection in the recess of the tooth holder comprising a straight projection extending in a direction generally parallel to a side wall of the tooth holder and the at least one recess in the tooth comprising a straight recess extending in a direction generally parallel to a side wall of the tooth, and the at least one recess on the tooth extending from a proximal end of the tooth towards a distal end of the tooth;

wherein the at least one projection is located on one only of the upper surface or the lower surface of the recess of the tooth holder and the at least one recess of the tooth is located on one only of the upper surface or the lower surface of the tooth.

13. A ground working tool comprising a tooth holder and a replaceable tooth, the tooth holder comprising a recess for receiving at least part of the tooth, the recess having an upper surface and an opposed lower surface, at least one projection of hard material extending from an upper surface or a lower surface of the tooth, the tooth comprising a distal part for engaging or working the ground or earth during use and a proximal part, the proximal part of the tooth being received within the recess of the tooth holder, the proximal part of the tooth having the upper surface and the lower surface, the tooth holder having at least one recess on the upper surface or the lower surface of the recess of the tooth holder, the at least one recess being of complementary size and shape to the at least one projection of hard material on the tooth such that the at least one projection is positioned within the at least one recess provided in the upper surface or the lower surface of the recess of the tooth holder when the tooth is fully inserted in the recess of the tooth holder, the at least one recess on the tooth holder and the at least one projection of hard material on the tooth being arranged such that the tooth can only be fully inserted into the recess of the tooth holder in a single orientation to the tooth holder and the hard material of the at least one projection being sufficiently hard to assist in firmly holding the tooth against lateral movement relative to the tooth holder to maintain alignment of the tooth in the ground working tool and prevent the tooth from being inserted into the recess of the tooth holder when the tooth is not in the single orientation, the at least one projection on the tooth comprising a straight projection extending in a direction generally parallel to a side wall of the tooth and the at least one recess in the tooth holder comprising a straight recess extending in a direction generally parallel to a side wall of the tooth holder, and the at least one recess on the tooth holder extending in a direction from a distal end of the tooth holder towards a proximal end of the tooth holder;

wherein the at least one projection is located on one only of the upper surface or the lower surface of the tooth and the at least one recess of the tooth holder is located on one only of the upper surface or the lower surface of the tooth holder.

14. A replaceable tooth for use with a ground working tool, the ground working tool having a tooth holder, the tooth holder comprising a recess for receiving at least part of the tooth, the recess having an upper surface and an opposed lower surface, at least one projection of hard material extending from an upper surface or a lower surface of the tooth, the tooth comprising a distal part for engaging or working the ground or earth during use and a proximal part, the proximal part of the tooth being received within the recess of the tooth holder, the proximal part of the tooth having the upper surface and the lower surface, the tooth holder having at least one recess on the upper surface or the lower surface of the recess of the tooth holder, the at least one recess being of complementary size and shape to the at least one projection of hard material on the tooth such that the at least one projection is positioned within the at least one recess provided on the upper surface or the lower surface of the recess of the tooth holder when the tooth is fully inserted in the recess of the tooth holder, the at least one recess in the tooth holder and the at least one projection of hard material on the tooth being arranged such that the tooth can only be fully inserted into the recess of the tooth holder in a single orientation to the tooth holder and the hard material of the at least one projection being sufficiently hard to assist in firmly holding the tooth against lateral movement relative to the tooth holder to maintain alignment of the tooth in the ground working tool and prevent the tooth from being inserted into the recess of the tooth holder when the tooth is not in the single orientation, the at least one projection on the tooth comprising a straight projection extending in a direction generally parallel to a side wall of the tooth and the at least one recess in the tooth holder comprising a straight recess extending in a direction generally parallel to a side wall of the tooth holder, and the at least one recess on the tooth holder extending in a direction from a distal end of the tooth holder towards a proximal end of the tooth holder;

wherein the at least one projection is located on one only of the upper surface or the lower surface of the tooth and the at least one recess of the tooth holder is located on one only of the upper surface or the lower surface of the tooth holder.

15. A tooth holder for a ground working tool, the tooth holder comprising a recess for receiving at least part of a tooth, the recess having an upper surface and an opposed lower surface, at least one projection of hard material extending from an upper surface or a lower surface of the tooth, the tooth comprising a distal part for engaging or working the ground or earth during use and a proximal part, the proximal part of the tooth being received within the recess of the tooth holder, the proximal part of the tooth having the upper surface and the lower surface, the tooth holder having at least one recess on the upper surface or the lower surface of the recess of the tooth holder, the at least one recess being of complementary size and shape to the at least one projection of hard material on the tooth such that the at least one projection is positioned within the at least one recess provided on the upper surface or the lower surface of the recess of the tooth holder when the tooth is fully inserted in the recess of the tooth holder, the at least one recess in the tooth holder and the at least one projection of hard material on the tooth being arranged such that the tooth can only be fully inserted into the recess of the tooth holder in a single orientation to the tooth holder and the hard material of the at least one projection being sufficiently hard to assist in firmly holding the tooth against lateral movement relative to the tooth holder to maintain alignment of the tooth in the ground working tool and prevent the tooth from being inserted into the recess of the tooth holder when the tooth is not in the single orientation, the at least one projection on the tooth comprising a straight projection extending in a direction generally parallel to a side wall of the tooth and the at least one recess in the tooth holder comprising a straight recess extending in a direction generally parallel to a side wall of the tooth holder, and the at least one recess on the tooth holder extending in a direction from a distal end of the tooth holder towards a proximal end of the tooth holder;

wherein the at least one projection is located on one only of the upper surface or the lower surface of the tooth and the at least one recess of the tooth holder is located on one only of the upper surface or the lower surface of the tooth holder.

* * * * *